US006032626A

United States Patent [19]

Haag

[11] Patent Number: 6,032,626

[45] Date of Patent: Mar. 7, 2000

[54] DEVICE FOR VARYING VALVE TIMING OF GAS EXCHANGE VALVES OF INTERNAL COMBUSTION ENGINES, PARTICULARLY A VANE-TYPE CAMSHAFT ADJUSTING DEVICE

[75] Inventor: Michael Haag, Nuremberg, Germany

[73] Assignee: Ina Walzlager Schaeffler oHG, Germany

[21] Appl. No.: 09/362,586

[22] Filed: Jul. 28, 1999

[30] Foreign Application Priority Data

Jul. 29, 1998 [DE] Germany ..... 198 34 143

[51] Int. Cl.[7] ..... F01L 1/344

[52] U.S. Cl. ..... 123/90.17; 123/90.37

[58] Field of Search ..... 123/90.15, 90.17, 123/90.31, 90.34, 90.37; 74/568 R; 464/1, 2, 160

[56] References Cited

U.S. PATENT DOCUMENTS

| | | | |
|---|---|---|---|
| 5,794,577 | 8/1998 | Kira | 123/90.17 |
| 5,823,152 | 10/1998 | Ushida | 123/90.17 |
| 5,860,397 | 1/1999 | Schafer | 123/90.17 |
| 5,875,750 | 3/1999 | Iwasaki et al. | 123/90.17 |

FOREIGN PATENT DOCUMENTS 0799976 10/1997 European Pat. Off. .

*Primary Examiner*—Weilun Lo
*Attorney, Agent, or Firm*—Bierman, Muserlian and Lucas

[57] ABSTRACT

A vane-type camshaft adjusting device for an internal combustion engine, comprising a drive pinion (2) connected in driving relationship to a crankshaft, and a winged wheel (8) connected rotationally fast to a camshaft (7), the drive pinion (2) comprises a hollow space (6) which is defined by a circumferential wall (3) and two side walls (4, 5), into which hollow space (6) is inserted the winged wheel (8) having at least one wing (10) on its wheel hub (9), limiting walls (11) defining at least one working chamber (13) in the hollow space (6) of the drive pinion (2), which working chamber (13) is divided into two hydraulic pressure chambers (16, 17) by a wing (10) of the winged wheel (8) with the limiting walls (11) of the drive pinion (2) in sealing contact by axial sealing elements or by sealing gaps with the wheel hub (9) of the winged wheel (8), while the wings (10) of the winged wheel (8) are in sealing contact by axial sealing elements with the circumferential wall (3) of the drive pinion (2) wherein the free end face (14) of each wing (10) of the winged wheel (8) and/or the free end face (12) of each limiting wall (11) of the drive pinion (2) comprises an elastic sealing spring (18) which is configured as a one-piece sealing element between two pressure chambers (16, 17) of the device (1) and which can be pressed by the pressure of the hydraulic pressure medium against the inner surface of the circumferential wall (3) of the drive pinion (2) or against the wheel hub (9) of the winged wheel (8).

5 Claims, 2 Drawing Sheets

DEVICE FOR VARYING VALVE TIMING OF GAS EXCHANGE VALVES OF INTERNAL COMBUSTION ENGINES, PARTICULARLY A VANE-TYPE CAMSHAFT ADJUSTING DEVICE

FIELD OF THE INVENTION

The invention concerns a device for varying valve timing of gas exchange valves of an internal combustion engine, particularly a vane-type camshaft adjusting device comprising:

a drive pinion configured as an outer rotor and connected in driving relationship to a crankshaft of the internal combustion engine by a traction means, said drive pinion having a hollow space defined by a circumferential wall and two side walls, a winged wheel configured as an inner rotor and connected rotationally fast to a camshaft of the internal combustion engine, which winged wheel is inserted into the hollow space of the drive pinion and has a wheel hub on whose periphery is radially arranged at least one wing, at least one hydraulic working chamber defined within the hollow space of the drive pinion by radial limiting walls extending from and inner surface of the circumferential wall towards a central longitudinal axis of the drive pinion, free end faces of the limiting walls being in sealing contact with the wheel hub of the winged wheel by sealing elements inserted in axial reception grooves, or alternatively by sealing gaps, said working chamber being divided into two hydraulic pressure chambers by one of the wings of the winged wheel, free end faces of the wings being in sealing contact in each working chamber with the inner surface of circumferential wall likewise by sealing elements inserted in axial reception grooves, or alternatively by sealing gaps, and a turning and/or fixing of the winged wheel relative to the drive pinion, and thus a relative rotation and/or a continuous hydraulic clamping of the camshaft relative to the crankshaft is obtained by an optional successive or simultaneous pressurizing of the pressure chambers by a hydraulic pressure medium.

BACKGROUND OF THE INVENTION

A generic camshaft adjusting device of the pre-cited type is known from EP 0 799 976 A1 and comprises a drive pinion configured as an outer rotor which is connected in driving relationship to a crankshaft of an internal combustion engine by a traction means, and a winged wheel configured as an inner rotor and connected rotationally fast to a camshaft of the internal combustion engine. The drive pinion comprises a hollow space defined by a circumferential wall and two side walls, into which hollow space is inserted the winged wheel which comprises four radially arranged wings on the periphery of its wheel hub. Four hydraulic working chambers are defined within the hollow space of the drive pinion by four uniformly spaced radial limiting walls which extend from the inner surface of the circumferential wall towards the central longitudinal axis of the drive pinion. Each of the working chambers is divided into two hydraulic pressure chambers by one of the wings of the winged wheel. For a sealing of the individual pressure chambers of the device relative to one another, the free end face of each of the limiting walls of the drive pinion comprises a sealing strip arranged in an axial reception groove and pre-tensioned by a separate leaf spring, said sealing strip being in sealing contact with the wheel hub of the winged wheel, while, at the same time, the free end faces of the wings of the winged wheel are in sealing contact with the inner surface of the circumferential wall of the drive pinion, likewise by sealing strips arranged in axial reception grooves and pre-tensioned by a leaf spring. Thus, by an optional successive or simultaneous pressurizing of the pressure chambers of the device by a hydraulic pressure medium, the winged wheel can be turned and/or fixed relative to the drive pinion to obtain a relative rotation and/or a continuous hydraulic clamping of the camshaft relative to the crankshaft.

A drawback of this prior art device is that each seal for the sealing of the pressure chambers of the device relative to one another consists of a sealing strip and a leaf spring, that is to say of two components so that, depending on the number of wings on the winged wheel and/or the number of limiting walls in the drive pinion, a great number of expensive components is required for the sealing of the pressure chambers of the device. Since the assembly of these components is mostly done manually, it is relatively cost-intensive and complicated, and it is not possible to exclude an unintentional omission or an unnoticed loss of one of these components, particularly of one of the leaf springs which are not visible in the assembled state. This can lead to leakage and thus, as experience has shown, to a malfunctioning of the device. Further, an addition of manufacturing tolerances in the width of the reception grooves for the sealing strips and in the width of the sealing strips themselves can lead to a canting of the sealing strips during the adjusting operation so that the sealing function of the sealing strips is strongly prejudiced and a higher wear of the device can occur. At extremely low temperatures, at which the hydraulic pressure medium has a high viscosity which causes higher shear forces in the gaps between the winged wheel and the drive pinion leading to increased friction therebetween, the prior art sealing strips tend to clamp or stick to the drive pinion and/or the winged wheel so that the desired adjusting times of the device cannot always be realized.

OBJECTS OF THE INVENTION

It is therefore an object of the invention to create a device for varying the timing of gas exchange valves of an internal combustion engine, particularly a vane-type camshaft adjusting device whose hydraulic pressure chambers are sealed from one another, as far as possible in a leak-tight manner, by low-cost and simple-to-mount sealing elements, which are not made up of several separate components and which guarantee a reliable sealing and adjusting function of the device over the entire temperature range of the internal combustion engine.

This and other objects and advantages of the invention will become obvious from the following detailed description.

SUMMARY OF THE INVENTION

The device of the invention for varying valve timing of gas exchange valves of an internal combustion engine, particularly a vane-type camshaft adjusting device comprises:

a drive pinion configured as an outer rotor and connected in driving relationship to a crankshaft of the internal combustion engine by a traction means, said drive pinion having a hollow space defined by a circumferential wall and two side walls, a winged wheel configured as an inner rotor and connected rotationally fast to a camshaft of the internal combustion engine, which winged wheel is inserted into the hollow space of the drive pinion and has a wheel hub on whose periphery is radially arranged at least one wing, at least one hydraulic working chamber defined within the hollow space of the drive pinion by radial limiting walls extending from an inner surface of the circumferential wall towards a central longitudinal axis of the drive pinion, free end faces of the limiting walls being in sealing contact with the wheel hub of the winged wheel by sealing elements inserted in axial reception grooves, or alternatively by sealing gaps, said working chamber being divided into two hydraulic pressure chambers by one of the wings of the winged wheel, free end faces of the wings being in sealing contact in each working chamber with the inner surface of circumferential wall likewise by sealing elements inserted in axial reception grooves, or alternatively by sealing gaps, and a turning and/or fixing of the winged wheel relative to the drive pinion, and thus a relative rotation and/or a continuous hydraulic clamping of the camshaft relative to the crankshaft is obtained by an optional successive or simultaneous pressurizing of the pressure chambers by a hydraulic pressure medium, wherein the free end face of each wing of the winged wheel and/or the free end face of each limiting wall of the drive pinion comprises an elastic sealing spring which is configured as a one-piece sealing element between two pressure chambers of the device and which can be pressed by the pressure of the hydraulic pressure medium against the inner surface of the circumferential wall of the drive pinion or against the wheel hub of the winged wheel, as the case may be, a pressure-receiving surface of the elastic spring for the hydraulic pressure medium corresponding approximately to the surface of the free end face of a wing of the winged wheel or to the surface of the free end face of a limiting wall of the drive pinion.

According to a further feature of the device of the invention, the sealing spring comprises, in cross-sectional profile, a preferably open hollow cylindrical trunk portion which is arranged in the reception groove in the free end face of each wing of the winged wheel or in the reception groove in the free end face of each limiting wall of the drive pinion respectively, and two spring wings extending from the trunk portion in opposite directions and having free ends which are in sealing contact with the inner surface of the circumferential wall of the drive pinion or with the wheel hub of the winged wheel respectively, so that the sealing spring as a whole has a generally Ω-shaped cross-sectional profile. The pressure-receiving surfaces of such a sealing spring are formed by the wing surfaces of the spring wings which preferably extend over the entire or almost entire width of the free end face of a wing of the winged wheel or of a limiting wall of the drive pinion. Their relatively large surfaces and the lever arms which are thus formed guarantee a high sealing force of the sealing springs. In place of the hollow cylindrical cross-sectional profile of the trunk portion of the sealing springs, it is also possible to use hollow cross-sectional profiles of other shapes such as square, rectangular or trapezoid, but solid cross-sectional profiles of these shapes may also be used.

The axial reception grooves of the sealing springs which are arranged preferably longitudinally centrally in the free end faces of the wings of the winged wheel and/or in the free end faces of the limiting walls of the drive pinion, possess cross-sectional profiles which are complementary in shape to the respective cross-sectional profile of the trunk portion of the sealing springs. Thus, in the case of the preferred hollow cylindrical cross-sectional profile of the trunk portion of the sealing springs, the reception grooves likewise have a cylindrical cross-section. In this way, the sealing springs can be mounted in the most simple of manners by a sideward insertion into the reception grooves on the wings of the winged wheel or on the limiting walls of the drive pinion and can be fixed in these reception grooves advantageously by positive engagement.

According to a further feature of the device of the invention, the free ends of the spring wings of the sealing springs are preferably bent toward the trunk portion. This advantageously permits a "soft" contact of the spring wings of the sealing springs on the respective sealing surface situated opposite thereto and simultaneously enables the formation of a slight lubrication wedge by the hydraulic pressure medium under the free ends of the spring wings. In this way, due to the axial linear sealing contact between the sealing springs and the inner surface of the circumferential wall of the drive pinion or the wheel hub of the winged wheel, as the case may be, frictional forces and, thus also, wear between the drive pinion and the winged wheel are reduced.

According to a final feature of the invention, the sealing springs are made preferably of a spring steel, and the hollow space of the open trunk portion of each sealing spring together with the hollow space defined by the spring wings of each sealing spring and the opposite sealing surface forms a collecting space for dirt particles contained in the hydraulic pressure medium. Due to the special geometry of the sealing springs, dirt particles contained in the hydraulic pressure medium which may pass under the free ends of the spring wings of the sealing springs and cause considerable malfunctions of the device can thus be captured and deposited in the substantially closed collecting spaces and prevented from reentering the hydraulic medium circuit of the device.

The device of the invention for varying the valve timing of gas exchange valves of an internal combustion engine thus has the advantage over prior art devices that each individual seal for the sealing of the hydraulic pressure chambers of the device relative to one another comprises only one single component so that the total number of sealing elements required for sealing the device is at least halved compared to prior art devices. In addition to the reduction of costs thus obtained, the fact that the sealing elements are configured as one-piece sealing springs which are very simple and economic to manufacture further reduces the costs of the device of the invention. Another advantage of the one-piece configuration of the sealing springs is that mounting work required for a device of the invention is greatly reduced because only one mounting step is necessary for fixing the sealing springs on the winged wheel or on the drive pinion, and an unintentional omission or an unnoticed loss of a sealing element can be detected at all times by a simple visual check.

An impairment of the sealing function of the sealing springs due to tilting during the adjusting operation is excluded in the device of the invention as is also a restriction of the adjusting function due to clamping or sticking of the sealing springs on the drive pinion and/or the winged wheel at extremely low temperatures because the elastic spring wings of the sealing springs are independent of manufacturing tolerances of the reception grooves of the sealing springs and, due to their linear sealing contact, they guarantee a reliable sealing and adjusting function of the device over the entire temperature range of the internal combustion engine.

The invention will now be described more closely with the help of an example of embodiment showing the attached drawings.

DETAILED DESCRIPTION OF THE DRAWINGS

Figure 1:
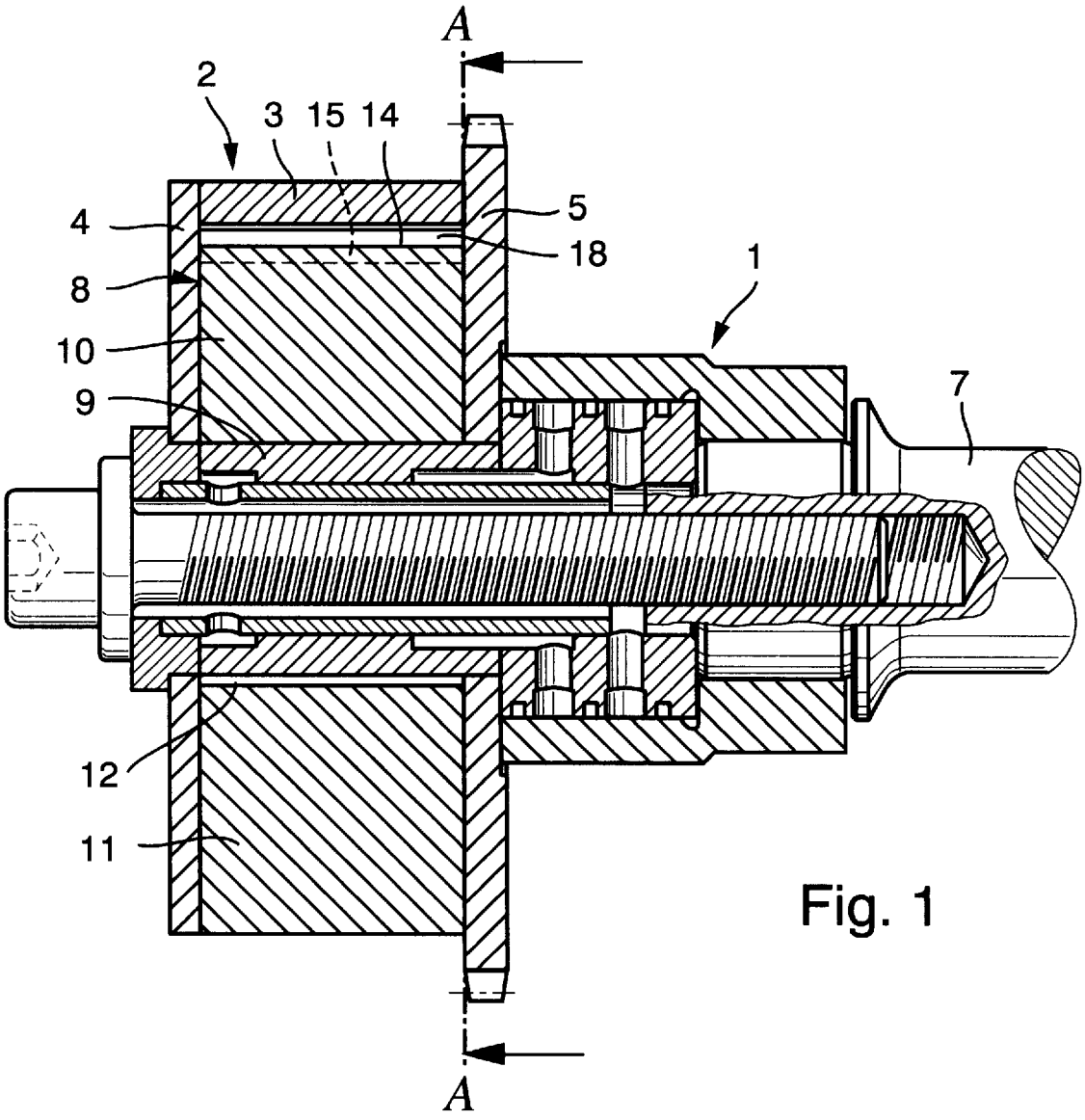
FIG. 1 is a cross-section through a vane-type camshaft adjusting device of the invention shown in installed position on a camshaft of an internal combustion engine.

FIG. 1 clearly shows a device 1 configured as a vane-type adjusting device for varying valve timing of gas exchange valves of an internal combustion engine. The device 1 comprises a drive pinion 2 configured as an outer rotor and a winged wheel 8 configured as an inner rotor. The drive pinion 2 is connected in driving relationship by a traction means to a crankshaft, not shown, of an internal combustion engine, while the winged wheel 8 is connected rotationally fast to a camshaft 7 of the internal combustion engine.

Figure 2:
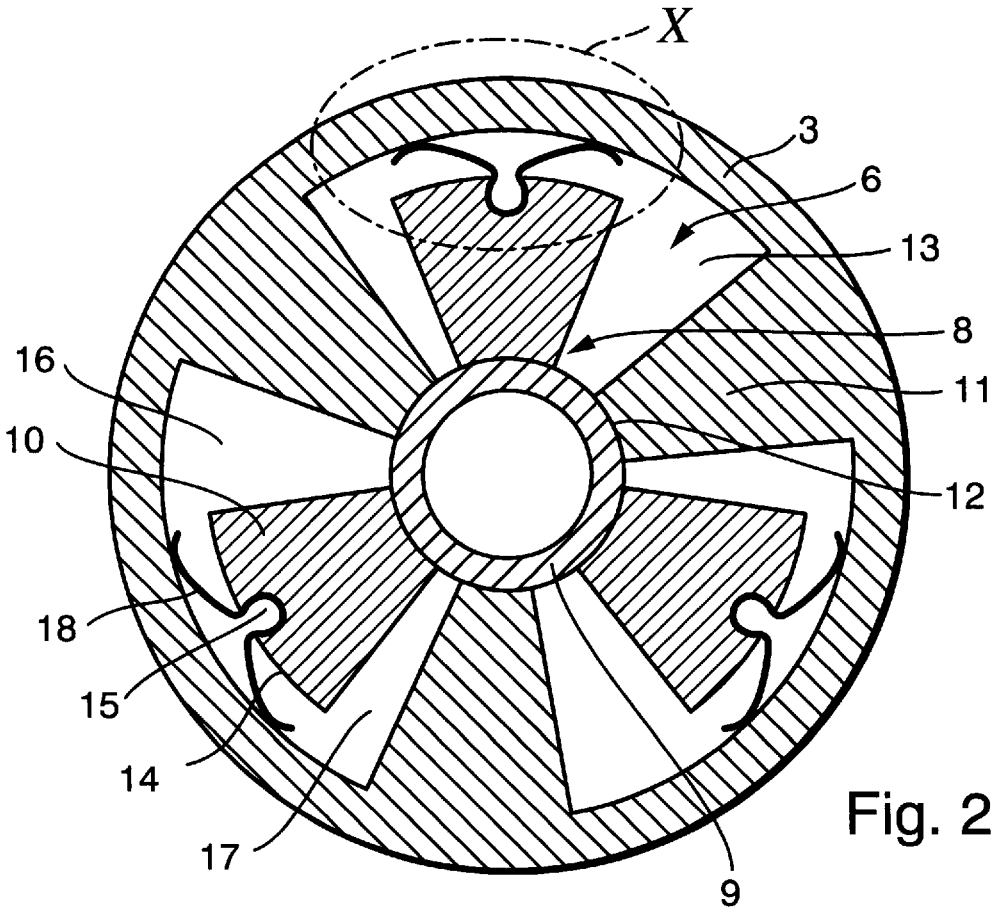
FIG. 2 is a sectional view of the camshaft adjusting device of the invention taken along A—A of FIG. 1.

It can be seen further in FIGS. 1 and 2 that the drive pinion 2 comprises a hollow space 6 defined by a circumferential wall 3 and two side walls 4, 5, into which hollow space 6 is inserted the winged wheel 8 which is configured with three wings or vanes 10 arranged radially on the periphery of its wheel hub 9. Three hydraulic working chambers 13 are formed in the hollow space 6 by three limiting walls 11 which extend from the inner surface of the circumferential wall 3 of the drive pinion, 2 towards the central longitudinal axis of the drive pinion 2. The free end faces 12 of the limiting walls 11 are in sealing contact with the wheel hub 9 of the winged wheel 8 by sealing gaps. Each of these hydraulic working chamber 13 is divided into two pressure chambers 16, 17 by a wing or vane 10 of the winged wheel 8. The free end face 14 of each wing 10 is in sealing contact with the inner surface of the circumferential wall 3 by a sealing element inserted into an axial reception groove 15. By an optional successive or simultaneous pressurizing of the pressure chambers 16, 17 by a hydraulic pressure medium, a turning and/or fixing of the winged wheel 8 relative to the drive pinion 2, and thus a relative rotation and/or a continuous hydraulic clamping of the camshaft 7 relative to the crankshaft is obtained.

The sectional view of FIG. 2 further shows that in the present example of embodiment of the device 1 of the invention, only the free end faces 14 of the wings 10 of the winged wheel 8 comprise a sealing element of the invention in the form of an elastic sealing spring 18 which can be pressed against the inner surface of the circumferential wall 3 of the drive pinion 2 by the pressure of the hydraulic pressure medium and which is configured as a one-piece sealing element between two pressure chambers 16, 17 of the device 1. In cross-sectional profile, this one-piece sealing spring 18, shown in an enlarged representation in FIG. 3 and arranged on each wing 10 of the winged wheel 8, possesses an open hollow cylindrical trunk portion 19 and two spring wings 20, 21 extending in opposite directions from the trunk portion 19. These wings 20, 21 serve as pressure-receiving surfaces and their free ends 22, 23 are in sealing contact with the inner surface of the circumferential wall 3 of the drive pinion 2. It can be clearly seen that the dimension of the spring wings 20, 21 in circumferential direction is such that the pressure-receiving surface of each sealing spring 18 for the hydraulic pressure medium corresponds approximately to the surface of the free end face 14 of a wing 10 of the winged wheel 8.

FIG. 2 further shows that the axial reception grooves 15 for the sealing springs 18, made in the present case longitudinally centrally in the free end faces 14 of the wings 10 of the winged wheel 8, have a cross-sectional profile which is complementary in shape to the cross-sectional profile of the trunk portion 19 of the sealing springs 18. Thus, because the trunk portion 19 of the sealing springs 18 has a hollow cylindrical cross-sectional profile, the cross-sectional profile of the reception grooves 15 is likewise hollow cylindrical so that the sealing springs 18 can be fixed in these reception grooves 15 by positive engagement without the use of further fixing elements.

Figure 3:
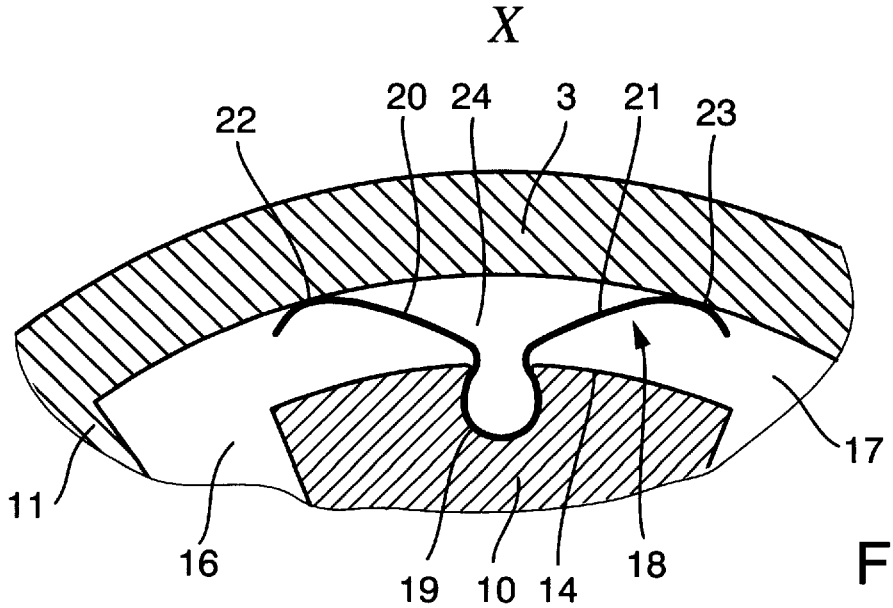
FIG. 3 is an enlarged representation of the detail X of FIG. 2.

Finally, it can be seen in FIG. 3 that the free ends 22, 23 of the spring wings 20, 21 of the sealing springs 18 are bent towards the trunk portion 19 of the sealing springs 18 and are thus in axial linear sealing contact with the inner surface of the circumferential wall 3 of the drive pinion 2. Since the sealing springs 18 are advantageously made of spring steel, the frictional forces between the drive pinion 2 and the winged wheel 8 can be minimized and wear of the device 1 can be reduced. At the same time, FIG. 3 clearly shows the hollow space of the open trunk portion 19 of each sealing spring 18 which, together with the hollow space defined by the spring wings 20, 21 of each sealing spring 18 and the inner surface of the circumferential wall 3 of the drive pinion 2 is configured as a collecting space 24 for dirt particles contained in the hydraulic pressure medium, so that malfunctions of the device 1 resulting from such dirt particles are also excluded to the greatest possible extent.

Various modifications of the device of the invention may be made without departing from the spirit or scope thereof and it is to be understood that the invention is intended to be limited only as defined in the appended claims.

What is claimed is:

1. A device for varying valve timing of gas exchange valves of an internal combustion engine, the device including a vane-type camshaft adjusting mechanism comprising:

a drive pinion configured as an outer rotor and connected in driving relationship to a crankshaft of the internal combustion engine by a traction means, said drive pinion having a hollow space defined by a circumferential wall and two side walls, a winged wheel configured as an inner rotor and fixedly connected to a camshaft of the internal combustion engine, which winged wheel is inserted into the hollow space of the drive pinion and has a wheel hub on whose periphery is radially arranged at least one wing, at least one hydraulic working chamber defined within the hollow space of the drive pinion by radial limiting walls extending from an inner surface of the circumferential wall towards a central longitudinal axis of the drive pinion, free end faces of the limiting walls being in sealing contact with the wheel hub of the winged wheel by sealing elements inserted in axial reception grooves, or alternatively by sealing gaps, said working chamber being divided into two hydraulic pressure chambers by one of the wings of the winged wheel, free end faces of the wings being in sealing contact in each working chamber with the inner surface of circumferential wall likewise by sealing elements inserted in axial reception grooves, or alternatively by sealing gaps, and at least one of a turning or fixing of the winged wheel relative to the drive pinion, and thus at least one of a relative rotation or a continuous hydraulic clamping of the camshaft relative to the crankshaft is obtained by an optional successive or simultaneous pressurizing of the pressure chambers by a hydraulic pressure medium, wherein the free end face of at least one of each wing of the winged wheel or the free end face of each limiting wall of the drive pinion comprises an elastic sealing spring which is configured as a one-piece sealing element between two pressure chambers of the device and which can be pressed by the pressure of the hydraulic pressure medium against the inner surface of the circumferential wall of the drive pinion or against the wheel hub of the winged wheel, as the case may be, a pressure-receiving surface of the elastic spring for the hydraulic pressure medium corresponding approximately to the surface of the free end face of a wing of the winged wheel or to the surface of the free end face of a limiting wall of the drive pinion.

2. A device of claim 1 wherein the sealing spring comprises, in cross-sectional profile, an open hollow cylindrical trunk portion and two spring wings configured as pressure-receiving surfaces extending from the trunk portion in opposite directions and having free ends which are in sealing contact with the inner surface of the circumferential wall of the drive pinion or with the wheel hub of the winged wheel.

3. A device of claim 2 wherein the axial reception grooves which are arranged longitudinally centrally in the free end faces of at least one of the wings of the winged wheel or in the free end faces of the radial limiting walls of the drive pinion, possess cross-sectional profiles which are complementary in shape to the cross-sectional profile of the trunk portion of the sealing springs, and the sealing springs can be fixed in these reception grooves by positive engagement.

4. A device of claim 2 wherein the free ends of the spring wings of the sealing springs are bent toward the trunk portion and are in axial linear sealing contact with the inner surface of the circumferential wall of the drive pinion or with the wheel hub of the winged wheel, as the case may be, and this axial linear sealing contact reduces frictional forces between the drive pinion and the winged wheel.

5. A device of claim 2 wherein the sealing springs are made of a spring steel, and the hollow space of the open trunk portion of each sealing spring together with the hollow space defined by the spring wings of each sealing spring and the opposite sealing surface forms a collecting space for dirt particles contained in the hydraulic pressure medium.

* * * * *